US008844157B2

(12) United States Patent
Wagner, Jr. et al.

(10) Patent No.: US 8,844,157 B2
(45) Date of Patent: Sep. 30, 2014

(54) BIOSOLIDS DRYING SYSTEM AND METHOD

(71) Applicant: AGL Resources Inc., Atlanta, GA (US)

(72) Inventors: Larry Ray Wagner, Jr., Rossville, GA (US); Gerald Harstine, Ooltewah, TN (US)

(73) Assignee: AGL Resources Inc., Atlanta, GA (US)

( * ) Notice: Subject to any disclaimer, the term of this patent is extended or adjusted under 35 U.S.C. 154(b) by 259 days.

(21) Appl. No.: 13/624,635

(22) Filed: Sep. 21, 2012

(65) Prior Publication Data

US 2013/0074357 A1 Mar. 28, 2013

Related U.S. Application Data

(60) Provisional application No. 61/538,469, filed on Sep. 23, 2011.

(51) Int. Cl.

| | |
|---|---|
| ***F26B 7/00*** | (2006.01) |
| ***F26B 25/06*** | (2006.01) |
| ***F26B 23/00*** | (2006.01) |
| *F26B 23/02* | (2006.01) |
| *F26B 11/04* | (2006.01) |
| *F26B 25/00* | (2006.01) |
| *F26B 23/10* | (2006.01) |

(52) U.S. Cl.

CPC ..... *F26B 7/00* (2013.01); *F26B 2200/18* (2013.01); *F26B 23/022* (2013.01); *F26B 25/06* (2013.01); *F26B 11/04* (2013.01); *F26B 11/0445* (2013.01); *F26B 25/007* (2013.01); *F26B 11/0481* (2013.01); *F26B 23/001* (2013.01); *F26B 23/10* (2013.01); *F26B 25/005* (2013.01); *Y10S 71/903* (2013.01)

USPC ..... 34/346; 34/359; 34/361; 34/167; 210/604; 210/610; 110/236; 110/346; 366/12; 588/249; 71/903; 47/1.42

(58) Field of Classification Search

USPC ..... 34/340, 346, 359, 361, 380, 381, 282, 34/201, 58, 86, 72, 82, 167, 173; 71/12, 71/13, 903; 210/604, 610, 770; 47/1.42; 588/249; 366/7, 8, 10, 12; 110/235, 110/236, 346

See application file for complete search history.

(56) References Cited

U.S. PATENT DOCUMENTS 3,938,434 A * 2/1976 Cox ..... 100/117
4,038,181 A * 7/1977 Talbert ..... 210/633

(Continued)

FOREIGN PATENT DOCUMENTS

EP 1855771 A1 * 11/2007 ..... C02F 1/04
GB 2427861 A * 1/2007

(Continued)

*Primary Examiner* — Steve M Gravini
(74) *Attorney, Agent, or Firm* — Sutherland Asbill & Brennan LLP

(57) ABSTRACT

Methods and systems are provided for drying wet biosolids to produce a class A biosolids. Generally described, the method of treating biosolids includes drying a wet biosolids in an indirect dryer to produce a partially dried biosolids and drying the partially dried biosolids in a direct dryer in series with and downstream of the indirect dryer to produce a class A biosolids. The indirect dryer and direct dryer may be operated at an average temperature of greater than about 100° C. and may have a total combined residence time of less than about 60 minutes. Also provided are systems for drying wet biosolids including an indirect biosolids dryer and a direct biosolids dryer in series. The methods and systems are particularly effective at reducing the moisture content of the biosolids from greater than 85% to less than 10% by weight.

25 Claims, 6 Drawing Sheets

(56) References Cited

U.S. PATENT DOCUMENTS

| | | | | |
|---|---|---|---|---|
| 4,098,006 | A | 7/1978 | Maffet | |
| 4,769,157 | A | 9/1988 | Bassler et al. | |
| 4,794,871 | A | 1/1989 | Schmidt et al. | |
| 4,951,417 | A * | 8/1990 | Gerken et al. | 47/1.42 |
| 5,215,670 | A * | 6/1993 | Girovich | 210/770 |
| 5,220,874 | A | 6/1993 | Keating, III et al. | |
| 5,283,959 | A | 2/1994 | Nagayoshi et al. | |
| 5,302,179 | A * | 4/1994 | Wagner | 71/13 |
| 5,305,533 | A | 4/1994 | Alexander et al. | |
| 5,428,906 | A | 7/1995 | Lynam et al. | |
| RE35,251 | E | 5/1996 | van den Broek | |
| 5,525,239 | A * | 6/1996 | Duske | 210/739 |
| 5,596,815 | A * | 1/1997 | Rice et al. | 34/346 |
| 5,915,815 | A | 6/1999 | Moore et al. | |
| 6,256,902 | B1 | 7/2001 | Flaherty et al. | |
| 6,410,283 | B1 | 6/2002 | Rehmat et al. | |
| 6,473,992 | B2 | 11/2002 | Suzuki | |
| 6,584,699 | B2 | 7/2003 | Ronning et al. | |
| 6,673,247 | B2 | 1/2004 | Olson | |
| 6,730,224 | B2 * | 5/2004 | Blackburn | 210/604 |
| 6,752,848 | B2 | 6/2004 | Logan et al. | |
| 6,752,849 | B2 | 6/2004 | Logan et al. | |
| 7,083,728 | B2 | 8/2006 | Logan et al. | |
| 7,334,347 | B2 * | 2/2008 | Mann et al. | 34/359 |
| 7,458,325 | B1 | 12/2008 | Hopper et al. | |
| 7,654,011 | B2 | 2/2010 | Ronning et al. | |
| 7,669,348 | B2 * | 3/2010 | Christy et al. | 34/361 |
| 7,819,931 | B2 | 10/2010 | Peltier et al. | |
| 8,464,437 | B1 * | 6/2013 | Weisselberg | 34/384 |
| 8,677,647 | B2 * | 3/2014 | Weisselberg | 34/167 |
| 8,726,538 | B2 * | 5/2014 | Weisselberg | 34/384 |
| 2008/0216346 | A1 | 9/2008 | Fernando et al. | |
| 2009/0300937 | A1 | 12/2009 | Gruenwald et al. | |
| 2010/0043246 | A1 | 2/2010 | Smith et al. | |
| 2011/0030431 | A1 | 2/2011 | Peltier et al. | |
| 2011/0041393 | A1 | 2/2011 | Sugita et al. | |
| 2013/0074357 | A1 * | 3/2013 | Wagner et al. | 34/282 |

FOREIGN PATENT DOCUMENTS

| | | | | |
|---|---|---|---|---|
| JP | 2008249212 | A * | 10/2008 | |
| WO | WO 2009115250 | A1 * | 9/2009 | B01D 53/14 |

* cited by examiner

BIOSOLIDS DRYING SYSTEM AND METHOD

CROSS-REFERENCE TO RELATED APPLICATIONS

The present application claims priority under 35 U.S.C. §119(e) to U.S. Provisional Application No. 61/538,469 filed on Sep. 23, 2011, entitled "Biosolids Drying System and Method," the disclosure of which is incorporated herein by reference in its entirety.

BACKGROUND

The disposal of sludges discharged from both municipal and industrial wastewater treatment plants continues to be a significant problem across the United States. In 1990, the United States Environmental Protection Agency indicated that a family of four discharged 300 to 400 gallons of wastewater per day. This amount had almost doubled in 2000. From this wastewater, publicly owned treatment works generated significant amounts of sludge (or "biosolids" as these municipal sludges are now called) that may be disposed of in a variety of ways, including conversion into fertilizers.

There remains a concern, however, with the long term effects of using biosolids in various land use applications, particularly in agriculture intended for human consumption. Possible negative effects may vary with the treatment of the biosolids (e.g., the level of disinfection that was applied to the biosolids prior to its usage). Many commercial biosolids processing technologies produce what is classed by the United States Environmental Protection Agency ("EPA") as a Class B biosolids, which still has potential pathogens present. The majority of biosolids processed in the United States are still processed using Class B type protocols.

Class A type protocols are particularly desirable, however, because there are significantly increased opportunities for use of Class A biosolids. Known processes for achieving Class A pathogen densities in biosolids are generally costly, and in some instances, cost prohibitive. Thus, it is desirable to develop a low-cost method of biosolids treatment for producing biosolids that will meet or exceed Class A standards.

SUMMARY

Embodiments of the present description provide methods for drying wet biosolids to produce class A biosolids. In embodiments, the method of drying biosolids comprises providing a wet biosolids; drying the wet biosolids in an indirect dryer to produce a partially dried biosolids; and drying the partially dried biosolids in a direct dryer in series with and downstream of the indirect dryer to produce a class A biosolids. Desirably, the wet biosolids has a moisture content of greater than about 85% and the class A biosolids has a moisture content of less than 10%. The indirect dryer and direct dryer desirably are operated at an average biosolids temperature of greater than about 100° C. and comprise a total combined residence time of less than about 60 minutes.

Also provided in embodiments of the present description are systems for drying wet biosolids to produce class A biosolids. In an embodiment, a system for drying wet biosolids comprises an indirect biosolids dryer and a direct biosolids dryer in series with and downstream of the indirect biosolids dryer. The indirect dryer comprises a first biosolids inlet for feeding wet biosolids to the indirect biosolids dryer and a first biosolids outlet for removing partially dried biosolids from the indirect biosolids dryer, whereas, the direct biosolids dryer comprises a second biosolids inlet for feeding the partially dried biosolids to the direct biosolids dryer and a second biosolids outlet for removing the class A biosolids from the direct biosolids dryer.

In still another embodiment, class A biosolids are provided prepared by the methods and using the systems described herein.

Additional aspects will be set forth in part in the description which follows, and in part will be obvious from the description, or may be learned by practice of the aspects described below. The advantages described below will be realized and attained by means of the elements and combinations particularly pointed out in the appended claims. It is to be understood that both the foregoing general description and the following detailed description are exemplary and explanatory only and are not restrictive.

DETAILED DESCRIPTION

Embodiments of the present description address the above-described needs by providing methods and systems for drying wet biosolids to produce class A biosolids. In particular, embodiments of the present description provide methods and systems for converting class B biosolids having high moisture contents to class A biosolids of exceptional quality without requiring pasteurization or use of the additives and treatment agents used in conventional biosolids treatment processes.

As used herein, the term "biosolids" refers to an organic sludge or waste. The biosolids may be obtained, for example, from waste water, landfills, animal or poultry plants, paper mills, animal feed industries, fish processing industries, etc. In particular embodiments, the biosolids may include organic wastes or sludges that have undergone one or more pretreatment or treatment steps, for example, at a wastewater treatment facility. In embodiments, the wet biosolids typically comprise greater than about 85% moisture, greater than about 90% moisture, or greater than about 95% moisture.

As used herein, the term "Class A Biosolids" means soil mediums having a Class A or "exceptional quality" rating according to U.S. EPA 40 C.F.R. Part 503. The class A biosolids desirably have a texture, appearance, and nutritional value suitable for use in land application (e.g., as soil amendment). In certain embodiments, the class A biosolids comprise less than about 10% moisture. For example, in embodiments the class A biosolids may comprise less than about 5% moisture, less than about 3% moisture, or less than about 1% moisture.

Figure 1:
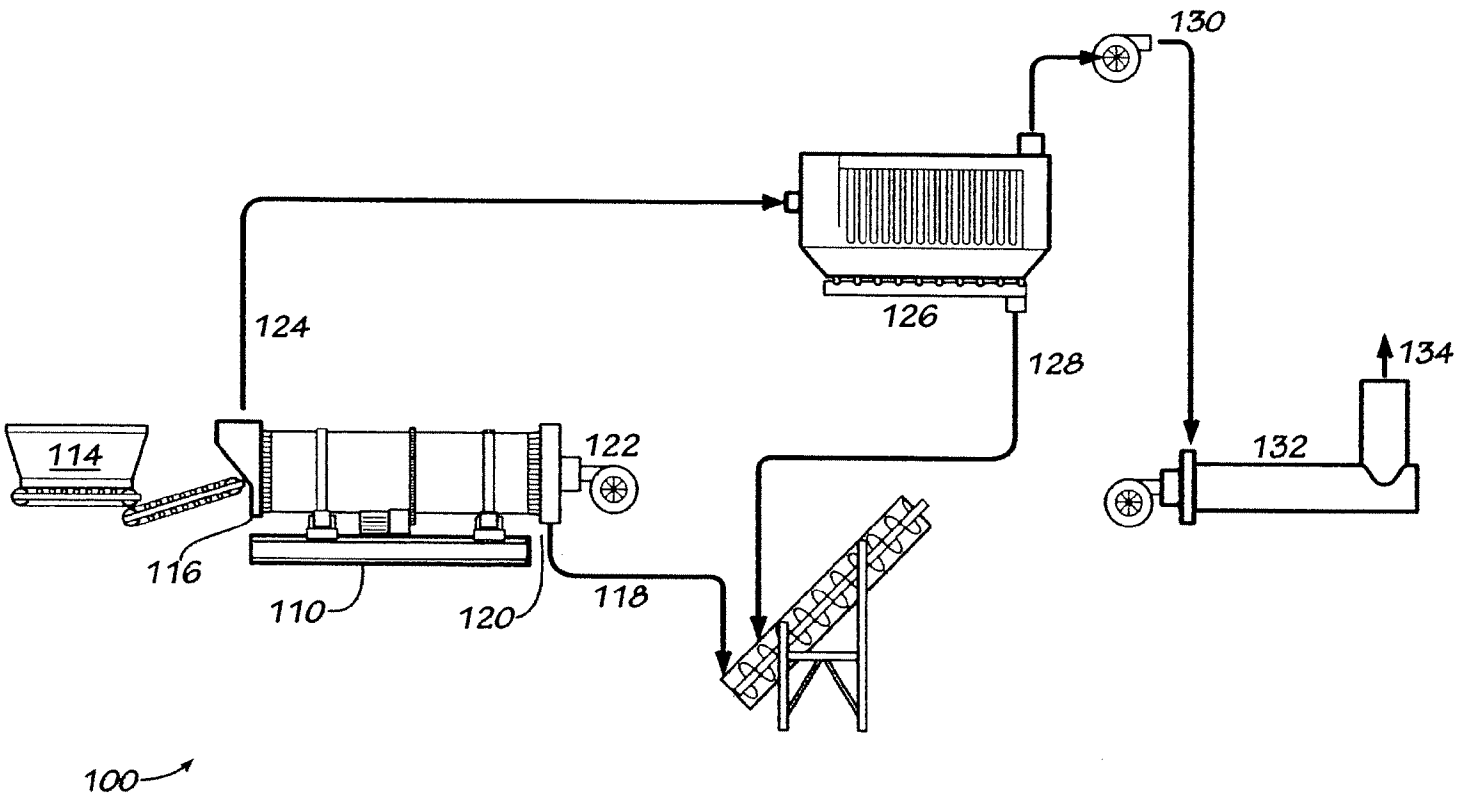
FIG. 1 is a schematic illustration of a system for drying biosolids using a rotary dryer according to an exemplary embodiment.
Figure 2:
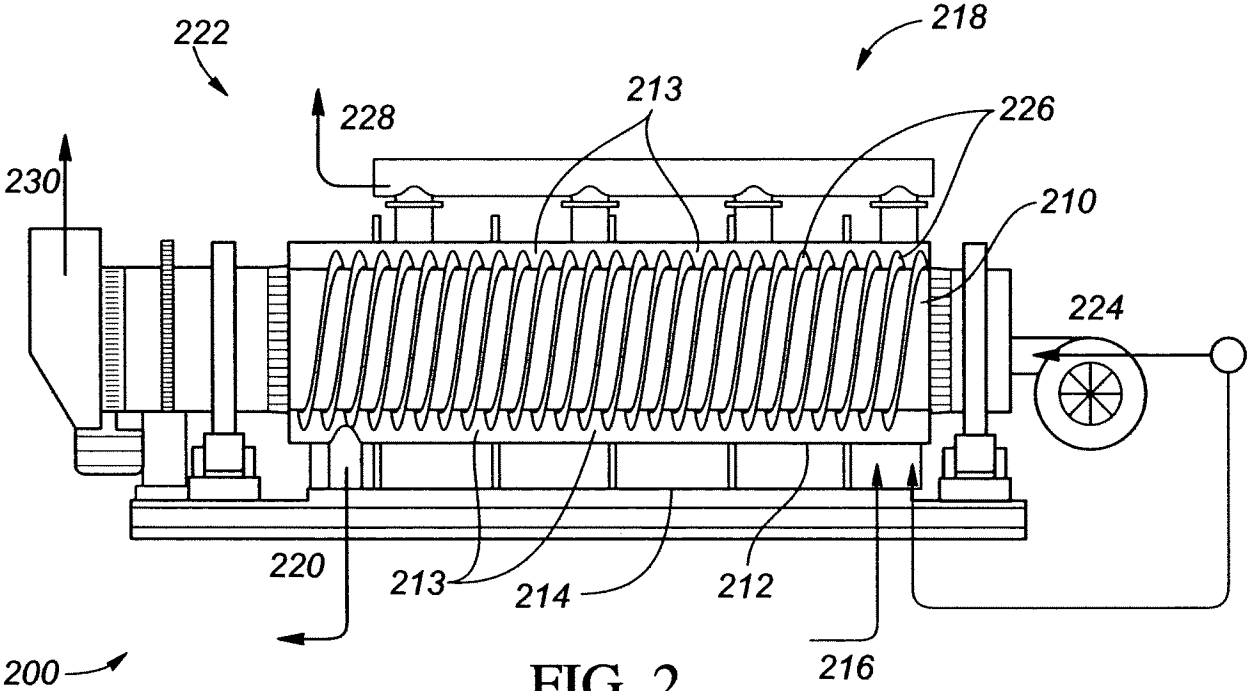
FIG. 2 is a cross-sectional side elevation view of an indirect biosolids dryer for drying biosolids according to an exemplary embodiment.
Figure 3:
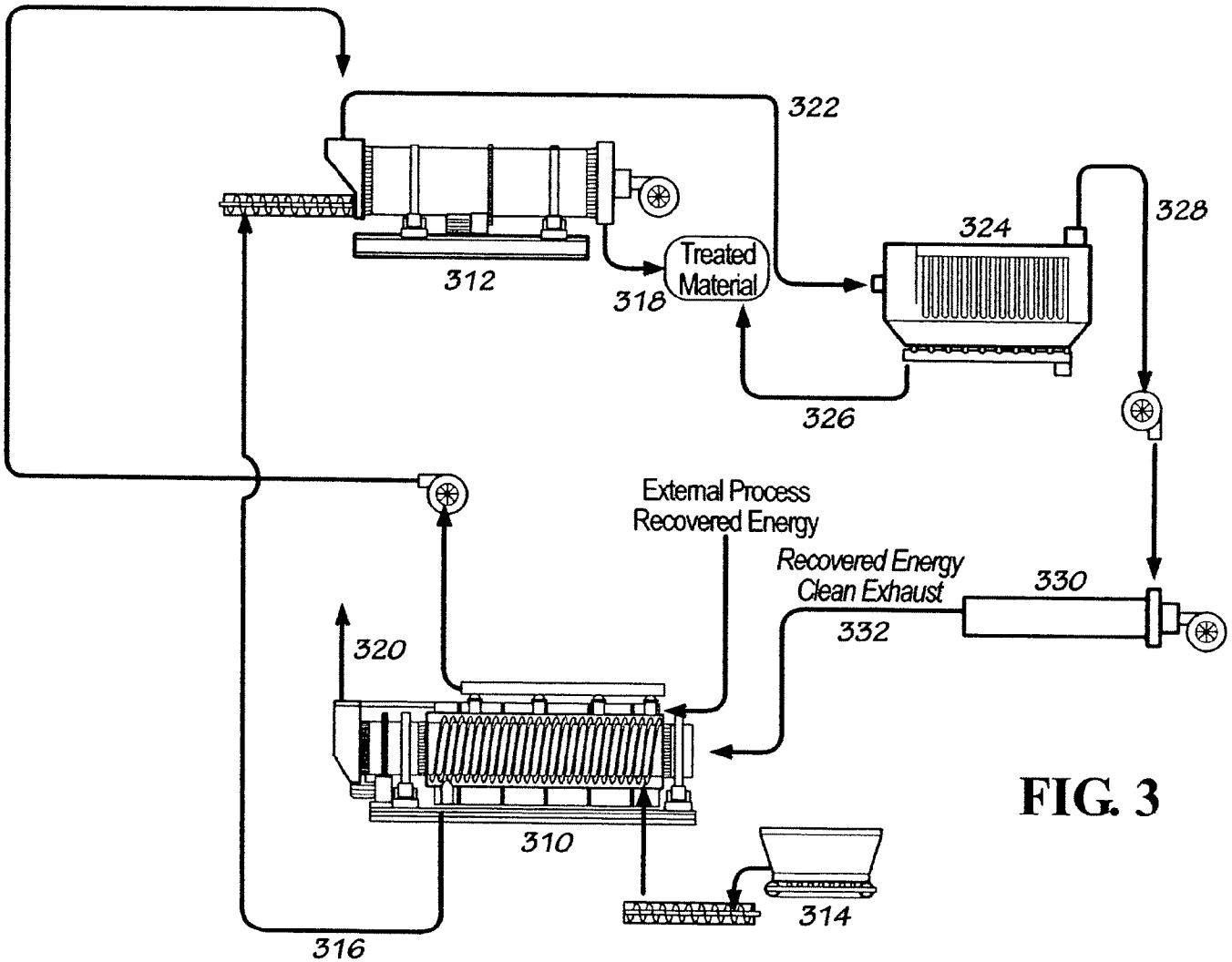
FIG. 3 is a schematic illustration of a system for drying biosolids using an indirect dryer and a rotary dryer in series according to an exemplary embodiment.

According to exemplary embodiments, biosolids drying systems are provided comprising a direct biosolids dryer as illustrated in FIG. 1, an indirect biosolids dryer as illustrated in FIG. 2, or an indirect biosolids dryer in series with a direct biosolids dryer as illustrated in FIG. 3.

Direct Biosolids Dryers

In an embodiment illustrated in FIG. 1, a direct biosolids dryer system 100 is provided comprising a rotary dryer 110. The rotary dryer generally comprises a biosolids inlet 112 for introducing wet biosolids from a biosolids feeder 114 into a first end 116 of the rotary dryer, a biosolids outlet 118 for removing the dried biosolids from a second end 120 of the rotary dryer, an auxiliary heat element 122 for directly heating the biosolids flowing through the rotary dryer either concurrent with or countercurrent to the biosolids flow. The rotary dryer 110 may further comprise one or more exhaust outlets 124 for removing exhaust gases from the rotary dryer. The exhaust gases then may be subsequently treated using methods known in the art. For example, a bag house 126 may be used to remove particulate material 128 from the exhaust gases 130 which then may be combined with the dried biosolids recovered from the biosolids outlet 118; a thermal oxidizer unit 132 may be used to destroy VOCs and release clean exhaust gas 134 to the atmosphere; or any combinations thereof.

Indirect Biosolids Dryer

Figure 2B:
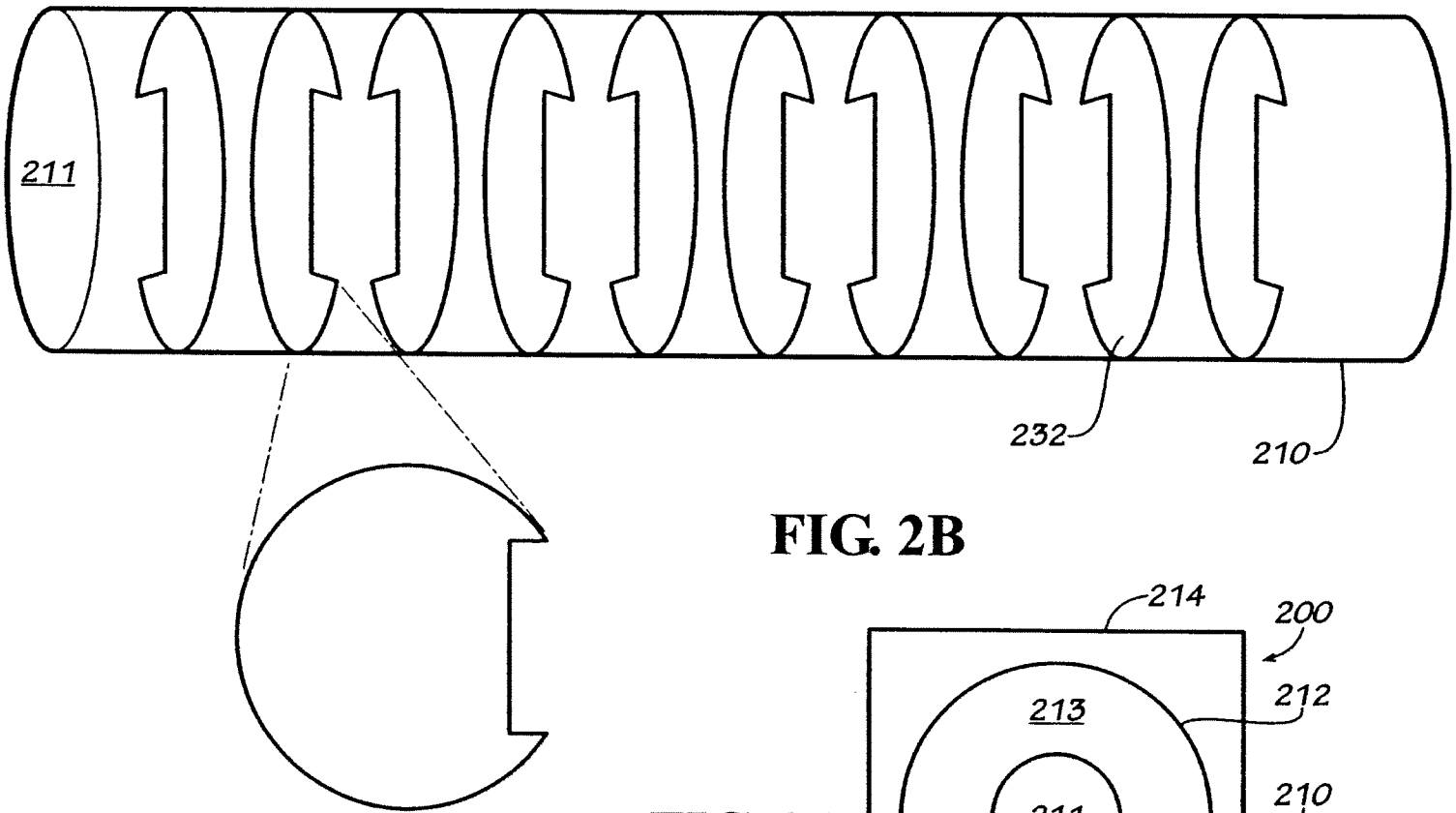
FIG. 2B is a cross-sectional end elevation view of an inner passageway of an indirect biosolids dryer according to an exemplary embodiment.
Figure 2A:
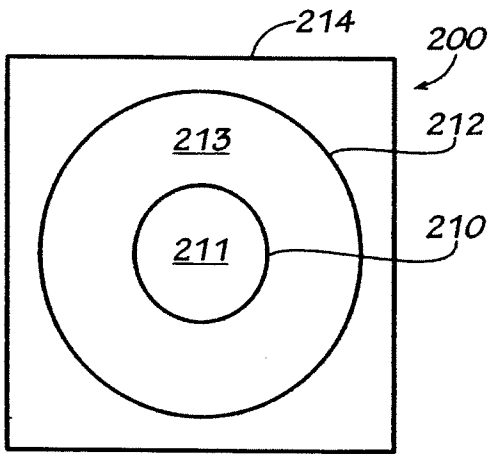
FIG. 2A is a cross-sectional end elevation view of the indirect biosolids dryer illustrated in FIG. 2.

In an embodiment illustrated in FIGS. 2 and 2A, an indirect biosolids dryer 200 is provided. Generally described, the indirect biosolids dryer 200 includes an inner rotary cylinder 210 defining an inner passageway 211 therethrough, an outer cylinder 212 concentric with and enclosing the inner rotary cylinder 210 and defining a biosolids passageway 213 between the outer cylinder 212 and the inner rotary cylinder 212, and a housing 214 encasing the outer cylinder 212. In embodiments, the indirect biosolids dryer 200 may further comprise a second outer cylinder concentric with the inner rotary cylinder and outer cylinder to form an outer passageway through which hot gases may be flowed (not shown).

A biosolids inlet 216 introduces the wet biosolids into the biosolids passageway 213 at a first end 218 of the indirect biosolids dryer 200. A biosolids outlet 220 discharges the partially or fully dried biosolids from the biosolids passageway 213 at a second end 222 of the indirect biosolids dryer 200 distal to the first end 218. An auxiliary heat element 224 (such as a heat exchanger) may be used to introduce hot gases into the inner passageway 211 and, optionally, the outer passageway (not shown). A steam outlet 228 in fluid communication with the biosolids passageway 213 and an exhaust outlet 230 in fluid communication with the inner passageway 211 and, optionally, the outer passageway (not shown), may be used to separately remove the steam and exhaust gases, respectively, from the indirect dryer 200 for subsequent treatment and/or recovered and recycled for further use as described herein.

In embodiments, the indirect biosolids dryer 200 further comprises a plurality of auger fins 226 extending outwardly in a helical pattern on the outer surface of the inner rotary cylinder 210 for assisting with the flow of the biosolids through the biosolids passageway 213. Not wishing to be bound by any theory, the configuration of fins disposed on the inner rotary cylinder (including the dimensions, pitch, spacing, and flights) may be modified to improve the heat transfer and efficiency of the indirect biosolids dryer. For example, in certain embodiments the fins may be spaced evenly along the axial length of the inner rotary cylinder, may have a variable pitch and/or spacing along the axial length of the inner rotary cylinder (i.e., wider at the inlet and narrower at the outlet), or any other such modifications that would be effective to enhance the mixing of the biosolids, the breaking of clumps in the biosolids, and the overall heat transfer of the indirect biosolids dryer.

In certain embodiments (FIG. 2B), the indirect biosolids dryer 200 further comprises a plurality of baffles 232 disposed in the inner passageway 211 of the inner rotary cylinder 210. Such baffles 232 may be positioned such that the "open" or "notched" portions of the baffles are offset along the axial length of the inner passageway 211, requiring the hot gases to flow through a more tortuous path. Not wishing to be bound by any theory, the use of such baffles may be effective, for example, at making the hot gas slowly and turbulently sweep through the inner passageway 211, thereby increasing the effective heat transfer.

Indirect and Direct Biosolids Dryer Systems

In particular embodiments, illustrated in FIG. 3, the biosolids drying systems comprise an indirect biosolids dryer 310 in series with a direct biosolids dryer 312. Desirably, the indirect 310 and direct biosolids dryers 312 can be arranged in series such that the wet biosolids 314 are initially fed to and partially dried in the indirect biosolids dryer 310, producing a partially dried biosolids 316 that then can be subsequently fed to the direct biosolids dryer 312 for further drying to obtain the class A biosolids having a reduced moisture content 318. The indirect dryer's exhaust gas 320 and the direct dryer's exhaust gas 322 may be recovered, optionally combined, and subsequently treated, for example, using a bag house 324 for removing the particulate material 326 from the exhaust gas 328; a thermal oxidizer unit 330 for destroying VOCs and recovering clean exhaust gas 332; or any combination thereof.

The auxiliary heat used to provide the hot gases to the indirect biosolids dryer 310 and the direct biosolids dryer 312 can be provided by any suitable energy source. For example, in certain embodiments heated gases may be provided by heating gases using combusted natural gas, landfill gas, or exhaust gases from combustion engines or other industrial combustion mechanisms (i.e., using propane, diesel, or gasification of other suitable products). In certain embodiments, the heated gases are provided by recovering and recycling energy directly from the biosolids drying system using one or more heat recovery systems. For example, hot gas from a thermal oxidizer used to destroy VOC's in exhaust gases produced by the biosolids drying system can be used as to provide the hot gases used to dry the biosolids in the direct or indirect dryer systems.

Those skilled in the art will appreciate that the temperatures of the indirect and direct dryers can be optimized as needed to improve the efficiency of the process and quality of the class A biosolids. As used herein, the temperature of the indirect and/or direct dryer means the average temperature of the biosolids in the indirect dryer, in the direct dryer, or in both the indirect and direct dryer. For example, in certain embodiments the biosolids dryer system dries the sludge at a temperature on average greater than about 100° C., to destroy the pathogens and produce class A biosolids, such as fertilizer, approved for use on crops. In one embodiment, the biosolids dryer system dries the sludge at temperatures on average of about 105° C.

However, those skilled in the art will appreciate that the temperatures of the heated air and exhaust at the inlets and outlets of the dryers as well as the temperatures of the biosolids at the inlets and outlets of the dryers and throughout the dryers will vary. For example, in an exemplary embodiment the heated gas in the inner passageway 211 of the indirect dryer is at a temperature of approximately 480° C., the temperature of the heated gas at the exhaust outlet 320 of indirect dryer is approximately 175° C., the temperature of the heated gas at the inlet (not shown) of the direct dryer is approximately 980° C., the temperature of the heated gas at the exhaust outlet of the direct dryer 322 is approximately 200° C., the temperature of the partially dried biosolids 316 exiting the indirect dryer is approximately 100° C., and the temperature of the biosolids 318 exiting the direct dryer is approximately 100-115° C.

Control Loops

In certain embodiments, the system further includes one or more elements to monitor the pressure, temperature, and flow of the biosolids at various points in the system. For example, the system may include one or more temperature elements strategically placed to measure the temperature of various inlet and outlet streams or one or more pressure transmitters to measure the pressure of various inlet and outlet streams. Use of such elements would thereby permit optimization of the process temperatures and pressures by adjustment, for example, of the biosolids feed rate and gas feed rate.

Figure 4:
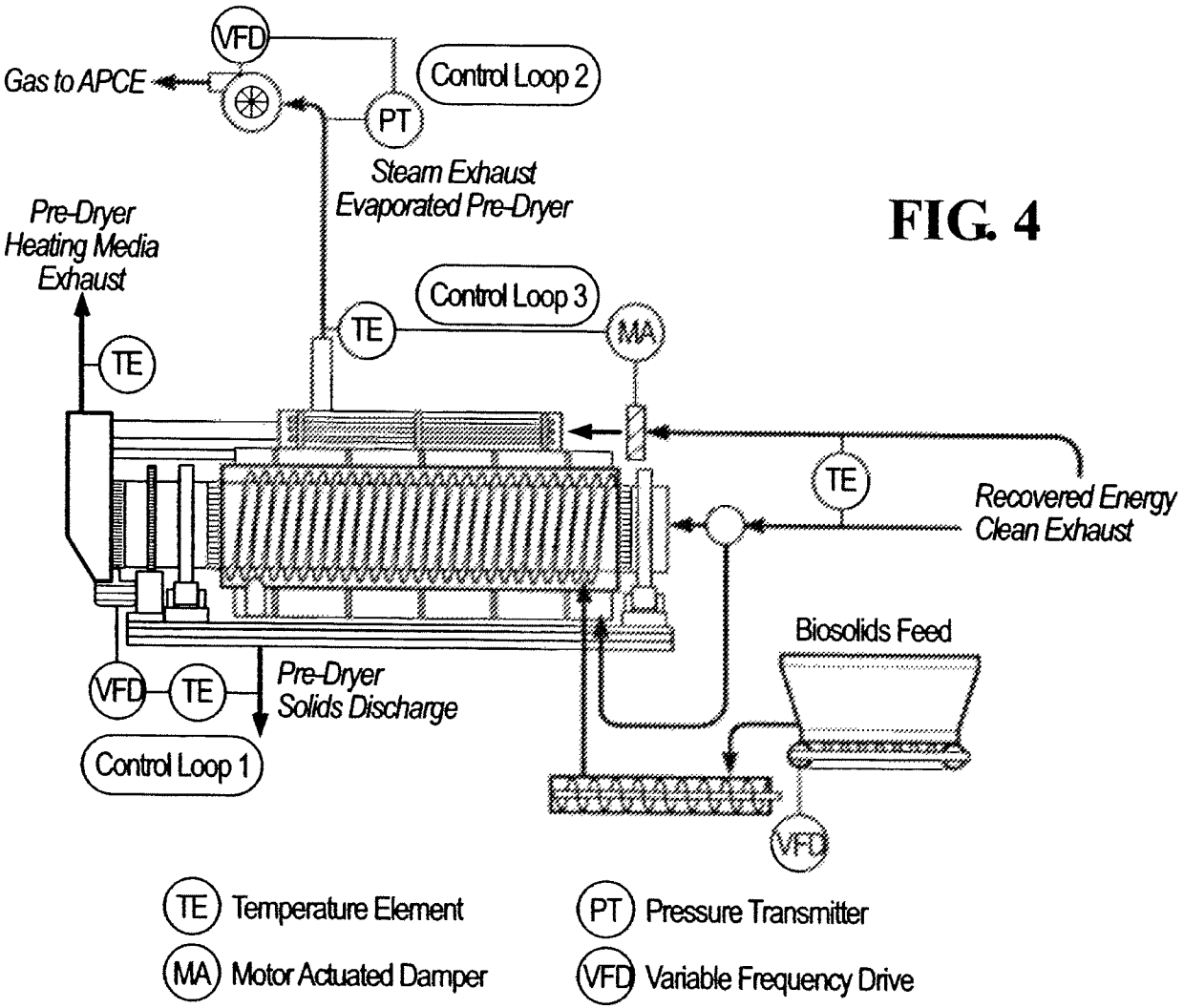
FIG. 4 is a schematic illustration of a feedback control system for use with an indirect biosolids dryer as illustrated in FIG. 2.

An exemplary feedback control system for an embodiment of an indirect biosolids dryer is illustrated in FIG. 4, and includes three different control loops: Control Loop 1, Control Loop 2, and Control Loop 3; however, those skilled in the art will appreciate that other control loops may be used to improve and optimize the efficiency of the system and the properties of the dried class A biosolids. Such feedback control systems may be either manually monitored and controlled or automatically monitored and controlled.

Control Loop 1 includes a temperature element to measure the temperature of the partially dried or dried biosolids exiting the indirect dryer. If the temperature is determined to be too low, the feed rate of the biosolids through the indirect dryer may be decreased by reducing the rotary speed of the inner rotary cylinder in order to increase the temperature to the desired target temperature. Conversely, if the outlet temperature of the biosolids is determined to be too high, the feed rate of the biosolids through the indirect dryer may be increased by increasing the rotary speed of the inner rotary cylinder to decrease the temperature to the desired target temperature.

Control Loop 2 includes a pressure element to measure the pressure of the exhaust gas exiting the indirect dryer. If the pressure is determined to be too low, the exhaust fan speed may be increased while the maintaining the feed rate of the hot gas to the indirect dryer in order to increase the pressure to the desired target pressure. If the pressure is determined to be too high, the exhaust fan speed may be decreased while maintaining the feed rate of the hot gas to the indirect dryer in order to decrease the pressure to the desired target pressure.

Control Loop 3 includes a temperature element to measure the temperature of the exhaust gas exiting the indirect dryer. If the temperature is determined to be too low, the feed rate of the hot gas to the auxiliary heat element (i.e., the heat exchanger) can be increased while maintaining the feed rate of the hot gas to the indirect dryer in order to increase the temperature of the exhaust gas to the desired target temperature. If the temperature is determined to be too high, the feed rate of the hot gas to the auxiliary heat element can be decreased while maintaining the feed rate of the hot gas to the indirect dryer in order to decrease the temperature of the exhaust gas to the desired temperature.

Not wishing to be bound by any theory, it is believed that by efficiently removing a significant amount of the moisture from the biosolids in the indirect dryer, the process enables more efficient removal of moisture from the biosolids in the direct dryer as well as a more efficient sterilization of the biosolids in the direct dryer. Thus, embodiments of the present description are believed to be particularly effective at converting wet biosolids to class A biosolids in a highly efficient process requiring a smaller footprint than conventional facilities.

In embodiments, the residence time of the biosolids drying systems provided herein is less than about 60 minutes, less than about 45 minutes, less than about 30 minutes, less than about 25 minutes, less than about 20 minutes, or less than about 15 minutes. Desirably, the biosolids drying systems also are capable of significantly reducing the volume of the biosolids during the treatment time (e.g., by at least 80% or a ratio of 5:1). Thus, in certain embodiments the indirect dryer is operable to remove up to about 2000-3000 lbs/hr of moisture from the biosolids (e.g., up to about 2250 lbs/hr, about 2500 lbs/hr, about 2750 lbs/hr) and the direct dryer is capable of removing up to about 5,000 lbs/hr of moisture from the biosolids. Moreover, embodiments of the present systems and methods desirably allow for the processing of significant amounts of biosolids, for example, about 150 wet tons of biosolids per day, to produce a class A biosolids having greater than 90% by weight biosolids.

In particular embodiments, the biosolids dryer system requires a surprisingly smaller space (i.e., footprint) than conventional treatment facilities to produce exceptional class A biosolids. For example, in certain embodiments the indirect dryer and direct dryer have a total combined axial length of about 15 ft to about 35 ft. For example, the indirect dryer may comprise an inner rotary cylinder having a diameter of about 3.5 ft and an outer cylinder having a diameter of about 4.5 ft and an axial length of about 10 ft. The direct dryer may comprise an inner rotary cylinder having a diameter of about 6 ft and an outer cylinder having a diameter of about 7 ft and an axial length of about 15 to about 25 ft. Thus, the total combined axial length of the indirect dryer and the direct dryer would be about 25 to about 35 ft.

Embodiments of the present description provide significant improvements over existing methods of treatment of biosolids to produce class A biosolids. For example, many biosolids treatment methods actually increase the final volume of material (i.e., by incorporating various additives in order to reduce the moisture content of the biosolids), require significant time and/or space, require transportation of class B biosolids to a separate treatment facility, or alter and degrade the quality of the reclaimed biosolids. As used herein, the term "additives" means materials not inherent to the untreated biosolids and/or that change or may potentially change the physical properties of the biosolids. Non-limiting examples of such additives include alkaline and mineral materials (e.g., lime, fly ash, incinerator ash, lime kiln dust, cement kiln dust, wood chips, sawdust, and soil) and other chemical additives (e.g., flocculating agents).

In addition, embodiments of the present description provide particularly desirable economic and environmental benefits over existing uses and disposal of class B biosolids. For example, numerous disadvantages are associated with disposal of class B biosolids in landfills, including the costs associated with transportation of the biosolids to the landfill (e.g., wear on roads, significant requirements for diesel fuel, use of landfill space that already is at a premium). Still further disadvantages are associated with disposal of class B biosolids by land application (e.g., distance of suitable sites for land application from large production treatment plants, cost and wear of truck transport, and potential health concerns and other problems) and by incineration (e.g., increasingly prohibitive cost of maintenance, cost of controlling air pollution, and disposal of ash produced).

Embodiments of the present description are further illustrated by the following examples, which are not to be construed in any way as imparting limitations upon the scope thereof. On the contrary, it is to be clearly understood that resort may be had to various other embodiments, modifications, and equivalents thereof which, after reading the description therein, may suggest themselves to those skilled in the art without departing from the spirit of the present invention and/or the scope of the appended claims. Unless otherwise specified, quantities referred to by percentages (%) are by weight (wt %).

EXAMPLES

Example 1

An exemplary embodiment of the above-described methods and systems has been operating at the Peachtree City Biosolids Treatment Facility operated by the Peachtree City Water and Sewerage Authority (WASA). The facility utilizes a direct dryer to transform sewage sludge having a moisture content of greater than 85% to class A biosolids having a moisture content of 10% or less. The gases from the system were routed through an air-filtration system and thermal oxidizer to ensure particulate removal and destruction of more than 99% of the volatile organic compounds present in the exhaust gas.

For every five pounds of sludge entering the dryer, one pound of class A biosolids is recovered (an 80% reduction). Moisture samples taken from the recovered class A biosolids on a batch basis, typically several times per week, were subjected to elemental analysis. The results are summarized in the table below:

| Element | PPM | Fraction | % | EPA Table III Metals: Lower Conc. (PPM) |
|---|---|---|---|---|
| Aluminum | 25,523 | 0.025523 | 2.55 | |
| Boron | 59.8 | 0.0000598 | 0.01 | |
| Cadmium | 9.62 | 9.62E−06 | 0.00 | 39 |
| Calcium | 27,834 | 0.027834 | 2.78 | |
| Chromium | 43.3 | 0.0000433 | 0.00 | |
| Copper | 1,003 | 0.001003 | 0.10 | 1,500 |
| Iron | 18,799 | 0.018799 | 1.88 | |
| Lead | 4.91 | 4.91E−06 | 0.00 | 300 |
| Magnesium | 2,859 | 0.002859 | 0.29 | |
| Manganese | 678 | 0.000673 | 0.07 | |
| Molybdenum | 9.42 | 9.42E−06 | 0.00 | N/A |
| Nickel | 19.1 | 0.0000191 | 0.00 | 420 |
| Phosphorus | 31,655 | 0.031655 | 3.17 | |
| Potassium | 6,185 | 0.006185 | 0.62 | |
| Silicon | 48.4 | 0.0000484 | 0.00 | |
| Sodium | 953 | 0.000953 | 0.10 | |
| Sulfur | 5,648 | 0.005648 | 0.56 | |
| Zinc | 1,465 | 0.001465 | 0.15 | 2,800 |
| Nitrogen | 48,500 | 0.0485 | 4.85 | |
| Phosphate | 72,500 | 0.0725 | 7.25 | |
| Potash | 7,500 | 0.0075 | 0.75 | |

In addition to achieving the necessary pathogen reduction (data not shown) and vector attraction reduction (by drying to at least 90% when unstabilized solids are used), embodiments of the methods and systems provided herein are capable of reducing the concentrations of trace elements and organic chemicals below that required to achieve classification as an exceptional quality (EQ) class A biosolid.

Example 2

Flat Plate Design Indirect Dryer

Figure 5:
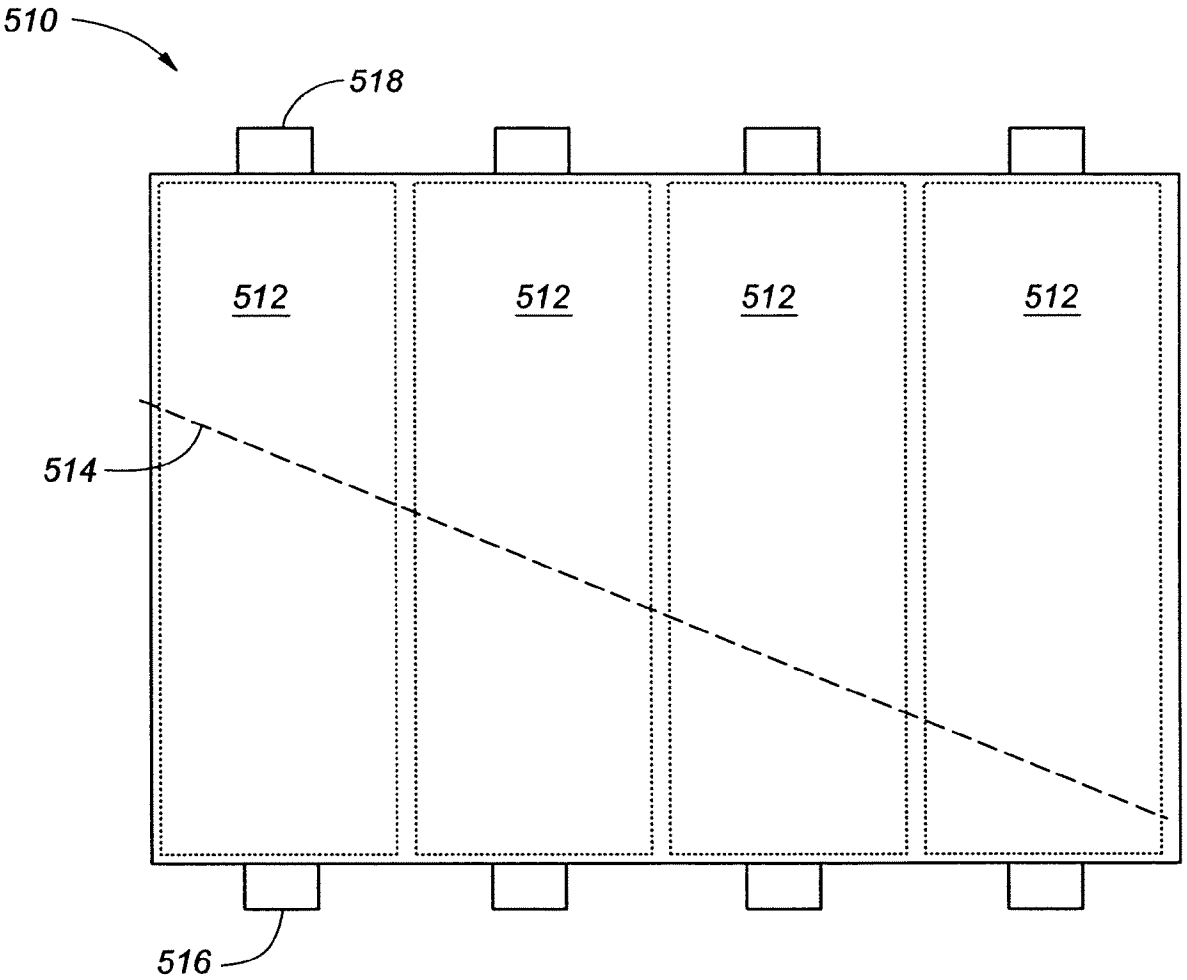
FIG. 5 is a cross-sectional schematic illustration of an indirect biosolids dryer for drying biosolids according to an exemplary embodiment.

An exemplary embodiment of an indirect dryer 510 is provided in FIG. 5. The indirect dryer 510 may be characterized as having a flat plate design comprising a plurality of chambers 512 and an inclined belt 514 for transporting the wet biosolids through the dryer from its inlet to its outlet (not shown). Any suitable number of chambers 512 may be used in the indirect dryer. Desirably, each of the chambers 512 forms an air-tight, independent heating compartment with its own gas inlet 516 and gas outlet 518. For example, in embodiments the indirect dryer 510 may comprise four chambers 512, each chamber receiving waste heat supplied from a different part of the process.

Those skilled in the art will appreciate that the inclined belt may be set at any suitable angle. For example, in embodiments the inclined belt 514 is at an angle from about 10 degree to about 45 degrees, from about 15 degrees to about 35 degrees, from about 20 degrees to about 30 degrees, or the like.

While the invention has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereof.

The invention claimed is:

1. A method of treating biosolids to produce a class A biosolids comprising:

providing a wet biosolids comprising a moisture content of greater than about 85% by weight;

drying the wet biosolids in an indirect dryer to produce a partially dried biosolids; and drying the partially dried biosolids in a direct dryer in series with and downstream of the indirect dryer to produce a class A biosolids comprising a moisture content of less than about 10% by weight, wherein the indirect dryer and direct dryer are operated at an average biosolids temperature greater than about 100° C. and comprise a total combined residence time of less than about 60 minutes.

2. The method of claim 1, wherein the total combined residence time of the indirect dryer and the direct dryer is less than about 60 minutes.

3. The method of claim 1, wherein the total combined residence time of the indirect dryer and the direct dryer is less than about 45 minutes.

4. The method of claim 1, wherein the indirect dryer and the direct dryer are operated at an average temperature greater than about 100° C.

5. The method of claim 1, wherein the indirect dryer and the direct dryer are operated at an average temperature greater than about 105° C.

6. The method of claim 1, wherein the wet biosolids comprise an organic waste or sludge originating from a waste water treatment facility, a landfill, an animal facility, a poultry facility, a paper mill, a feed processing facility, a fish processing facility, or a combination thereof.

7. The method of claim 1, wherein the wet biosolids comprise greater than about 85% moisture.

8. The method of claim 1, wherein the wet biosolids comprise greater than about 90% moisture.

9. The method of claim 1, wherein the class A biosolids comprise less than about 5% moisture.

10. The method of claim 1, wherein the class A biosolids comprise less than about 3% moisture.

11. The method of claim 1, wherein the class A biosolids comprise less than about 1% moisture.

12. The method of claim 1, wherein the class A biosolids comprise a granular product suitable for use as a soil amendment.

13. The method of claim 1, wherein the method is performed substantially without use of additives.

14. A soil amendment comprising the class A biosolids produced by the method of claim 1.

15. A system for treating wet biosolids to produce a class A biosolids comprising:

an indirect biosolids dryer comprising a first biosolids inlet for feeding wet biosolids to the indirect biosolids dryer and a first biosolids outlet for removing partially dried biosolids from the indirect biosolids dryer; and a direct biosolids dryer downstream of the indirect biosolids dryer, wherein the direct biosolids dryer comprises a second biosolids inlet for feeding the partially dried biosolids to the direct biosolids dryer and a second biosolids outlet for removing a class A biosolids from the direct biosolids dryer, wherein the system is effective at producing a class A biosolids comprising a moisture content of less than about 10% by weight from a wet biosolids comprising a moisture content of greater than about 85% by weight.

16. The system of claim 15, wherein the indirect biosolids dryer comprises:

an inner rotary cylinder defining an inner passageway;

an outer cylinder concentric with and enclosing the inner rotary cylinder and defining a biosolids passageway between the outer cylinder and the inner rotary cylinder; and a housing encasing the inner rotary cylinder and the outer cylinder;

wherein the first biosolids inlet introduces the wet biosolids into the biosolids passageway at a first end of the indirect biosolids dryer, the first biosolids outlet discharges the partially dried biosolids from the biosolids passageway at a second end of the indirect biosolids dryer distal to the first end, a hot gas inlet for introducing hot gas into the inner passageway at the first end of the indirect biosolids dryer, an exhaust gas outlet for removing exhaust gases from the inner passageway at the second end of the indirect dryer, and a steam outlet for removing steam from the second end of the indirect biosolids dryer.

17. The system of claim 16, wherein the indirect biosolids dryer further comprises an auger fin extending outwardly in a helical pattern in biosolids passageway from an outer surface of the inner rotary cylinder.

18. The system of claim 16, wherein the indirect biosolids dryer further comprises a plurality of baffles disposed in the biosolids passageway.

19. The system of claim 15, wherein the direct biosolids dryer comprises a countercurrent rotary dryer.

20. The system of claim 15, further comprising one or more heat recovery systems.

21. The system of claim 15, further comprising a thermal oxidizer for treating exhaust gases from the indirect biosolids dryer, the direct biosolids dryer, or a combination thereof.

22. The system of claim 15, further comprising a bag house for removing particulate material from exhaust gases recovered from the indirect biosolids dryer, the direct biosolids dryer, or a combination thereof.

23. The system of claim 15, wherein the indirect biosolids dryer comprises a flat plate dryer comprising a plurality of chambers.

24. The system of claim 23, wherein the indirect biosolids dryer further comprises an inclined belt for transporting the wet biosolids from the first biosolids inlet to the first biosolids outlet.

25. The system of claim 24, wherein the inclined belt is positioned at an angle from about 20 to about 30 degrees.

* * * * *